United States Patent [19]

Kuramoto et al.

[11] Patent Number: 4,657,374

[45] Date of Patent: Apr. 14, 1987

[54] DEVELOPMENT SYSTEM FOR PHOTORECEPTOR HAVING SURFACE POTENTIAL AND A LARGE AMOUNT OF CHARGE

[75] Inventors: Yukimasa Kuramoto, Takarazuka; Eiichiro Tanaka, Kishiwada, both of Japan

[73] Assignee: Matsushita Electric Industrial Co., Ltd., Kadoma, Japan

[21] Appl. No.: 746,113

[22] Filed: Jun. 18, 1985

[30] Foreign Application Priority Data

Jun. 23, 1984 [JP] Japan ..... 59-129864
Nov. 10, 1984 [JP] Japan ..... 59-235979

[51] Int. Cl.[4] ..... G03G 15/00; G03G 15/08

[52] U.S. Cl. ..... 355/3 R; 355/3 DR; 355/3 DD; 355/3 BE

[58] Field of Search ..... 355/3 DR, 3 R, 3 DD, 355/14 D, 14 R

[56] References Cited

U.S. PATENT DOCUMENTS 4,363,861 12/1982 Nakamura et al. ..... 355/3 DD
4,484,809 11/1984 Coleman ..... 355/3 DR
4,565,438 1/1986 Folkins ..... 355/14 D X

*Primary Examiner*—A. C. Prescott
*Attorney, Agent, or Firm*—Wenderoth, Lind & Ponack

[57] ABSTRACT

An electrophotographic apparatus which includes a photoreceptor mainly composed of amorphous silicone and a developing device employing a developing material including electrically insulative composite components. The developing device has a developing sleeve impressed with developing bias voltage on which AC voltage is superposed, and a magnetic roller having magnetic poles and accommodated within the developing sleeve.

9 Claims, 2 Drawing Figures

DEVELOPMENT SYSTEM FOR PHOTORECEPTOR HAVING SURFACE POTENTIAL AND A LARGE AMOUNT OF CHARGE

BACKGROUND OF THE INVENTION

The present invention generally relates to electrophotography and more particularly, to an electrophotographic apparatus which may be applied, for example, to a copying machine, reader-printer or the like.

In FIG. 1, there is schematically shown a side sectional view of a conventional electrophotographic apparatus as applied to an electrophotographic copying machine, which generally includes a photoreceptor drum 1 having a photosensitive or photoreceptor layer 1*a* for example, of a selenium photosensitive material applied onto the outer peripheral surface of the drum 1 and rotatably provided generally at a central portion for rotation in a direction indicated by the arrow, while a corona charger 4 for uniformly charging the photoreceptor layer 1*a*, an optical system having a light source S for illuminating an original document O placed on a transparent platform P and a lens L for forming an electrostatic latent image of the original document O on the photoreceptor surface 1*a*, a developing device 2 for developing the latent image into a visible toner image, a transfer charger T, and a cleaner blade B, etc. are sequentially disposed around the photoreceptor drum 1 in a known manner.

The developing device 2 further includes a housing 2*a*, a magnet roll 3 having a developing sleeve 6 adapted to rotate in the direction of the arrow and impressed with DC developing bias voltage V in the range of +150 V to +400 V for eliminating fogging in a resultant image and a magnetic roller M fixedly provided within said developing sleeve 6.

Hereinbelow, operation of the conventional electrophotographic copying machine in FIG. 1 will be described.

The photoreceptor layer 1*a* of the photoreceptor drum 1 is uniformly charged up to voltages in the range of +700 to +800 V by the corona charger 4 so as to subsequently have the electrostatic latent image of the original document O formed thereon by the exposure through the optical system, and said latent image is then developed into the visible toner image by the developing device 2 in which a dual or two-component developing material composed of electrically conductive iron particle carrier and toner is contained, with the distance between the surface of the developing sleeve 6 and the photoreceptor layer 1a of the drum 1, i.e., the so-called developing gap being set to be in the range of 1 to 5 mm.

Meanwhile, as another prior art arrangement of this kind, there have conventionally been proposed, for example, in U.S. Pat.. Nos. 3,890,929, 3,866,574 and 3,893,418, electrophotographic apparatuses utilizing a flying developing method by a mono-component developing material composed only of non-contacting toner.

In the prior art references as referred to above, for effectively charging toner by the corona charger, the thickness of the toner layer is set to less than 0.1 mm so as to be smaller than the distance between the surface of the developing sleeve and the photoreceptor surface of the drum, and the toner layer is kept out of contact with the photoreceptor surface, so that the toner adheres onto said photoreceptor surface by flying.

In the conventional arrangement as described so far, due to the fact that the photoreceptor layers of selenium, organic photo semiconductor, etc. have inferior resistance to rubbing, the time period from maintenance to maintenance for the electrophotographic apparatus is undesirably shortened, and even if the conventional photoreceptor is replaced by a photoreceptor mainly composed of amorphous silicone, there is still a problem that, since the amorphous silicone photoreceptor layer has a small in thickness, with low surface potentials in the range of 200 to 400 V, it is difficult to obtain high image density, contrast and resolution.

Moreover, in the electrophotographic apparatus utilizing the flying developing method of the non-contacting mono-component developing material, it is necessary to keep the toner layer uniformly thin at a thickness less than 0.1 mm, and if the toner layer is apt to contact the photoreceptor surface, the distance between the surface of the developing sleeve and the photoreceptor surface must be set smaller than the thickness of the toner layer, thus requiring a high accuracy difficult to be achieved. Furthermore, since the developing method utilizes the flying of toner, there is a tendency for scattering of toner, with a consequently insufficient resolution of the resultant images.

SUMMARY OF THE INVENTION

Accordingly, an essential object of the present invention is to provide an improved electrophotographic apparatus in which the time period from maintenance to maintenance is sufficiently long, and which is capable of providing high image density, contrast and resolution, with a substantial elimination of the disadvantages inherent in the conventional apparatuses of this kind.

Another important object of the present invention is to provide an electrophotographic apparatus of the above described type which is simple in construction and stable in functioning, and can be readily applied to copying machines and the like at low cost.

In accomplishing these and other objects, according to one preferred embodiment of the present invention, there is provided an electrophotographic apparatus which comprises a photoreceptor mainly composed of amorphous silicone and a developing device containing a developing material composed of electrically insulative composite components, and is characterized in that the thickness of the layer of the developing material on the developing sleeve in the developing device is set to be larger than the distance between the surface of the developing sleeve and the surface of the photoreceptor, which is in the range of 0.2 to 1 mm, with AC voltage being superposed onto the developing bias voltage applied to said developing sleeve.

In the above arrangement of the present invention, the photoreceptor mainly composed of amorphous silicone has a high surface hardness, with a superior resistance to rubbing, and may be used semi-permanently, with almost no necessity for replacement thereof, and thus, the time period from maintenance to maintenance can be advantageously prolonged. Meanwhile, since the photoreceptor mainly composed of amorphous silicone has a slow film forming speed, the thickness can be made small, i.e. in the range of 10 to 20 μm, by taking the productivity into account, and therefore, the surface potential thereof is low, i.e. from 200 to 400 V. Accordingly, for enabling the toner contained in the developing device, to electrostatically adhere onto the photoreceptor surface, the developing electric field between the developing sleeve of the developing apparatus and the photoreceptor is rather weak, and therefore, in order to strengthen this developing electric field, the distance between the surface of the developing sleeve and the photoreceptor surface is reduced to the range of 0.2 to 1 mm from the distance therebetween in the range of 1 to 5 mm for the conventional arrangement, with AC voltage being superposed onto the developing bias voltage applied to the developing sleeve. Since the developing electric field between the developing sleeve and the photoreceptor becomes considerably strong at a peak period upon superposition of the AC voltage onto the developing bias voltage, the developing material is caused to be electrically insulative for the prevention of breakdown due to discharge. Meanwhile, the layer thickness of the developing material composed of the composite components may be set to be larger than the distance between the surface of the developing sleeve and the photoreceptor surface, i.e., the developing gap, due to the fact that the respective components are effectively charged. Therefore, a uniform layer of the developing material can be obtained even without controlling the layer thickness of the developing material with high accuracy.

By the superposition of the AC voltage as described above, efficiency for the triboelectric charging of the developing material is improved, and consequently, the number of toner particles in the charged composite components is increased. On the other hand, the electrical charge on the photoreceptor surface mainly composed of amorphous silicone has a specific inductive capacity of about 10 which is larger than that of 6 for selenium even when the surface potential is low at 200 to 400 V, while the film thickness of said photoreceptor is in the range of 10 to 20 μm which is smaller than that of selenium at 40 to 60 μm, and thus, the electrical charge on said photoreceptor surface is about three times as large as that of selenium having the surface potential in the range of 700 to 800 V. Therefore, an increased number of charged toner particles may be attracted onto the amorphous silicone photoreceptor surface at low potential for raising the image density. By the improved efficiency of the triboelectrical charging of the developing material through superposition of the AC voltage, the amount of toner particles with a small charge or those negatively charged is decreased, and it becomes difficult for the toner to adhere to the portion of the photoreceptor at which the surface potential is close to zero, and thus, by the large charge amount on the photoreceptor surface and the strong developing electric field, contrast and resolution of the images are further improved as compared to the case where only the DC bias voltage is applied. In the above state, the DC bias voltage has the function to eliminate the fogging in the image.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
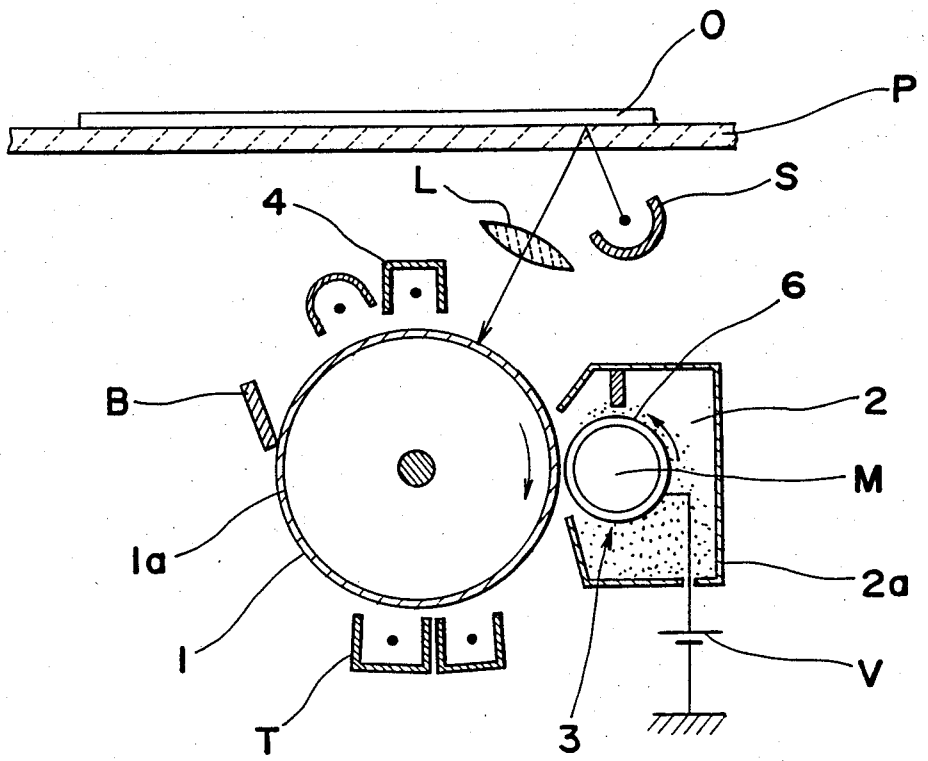
Fig. 1 PRIOR ART
FIG. 1 is a schematic side sectional view of a conventional electrophotographic apparatus as applied to an electrophotographic copying machine (already referred to)

Before the description of the present invention proceeds, it is to be noted that like parts are designated by like reference numerals throughout the accompanying drawings.

Referring now to the drawings, preferred embodiments of the present invention will be described hereinbelow for the purpose of illustrating the invention without any intention of limiting the scope thereof.

Embodiment 1

Figure 2:
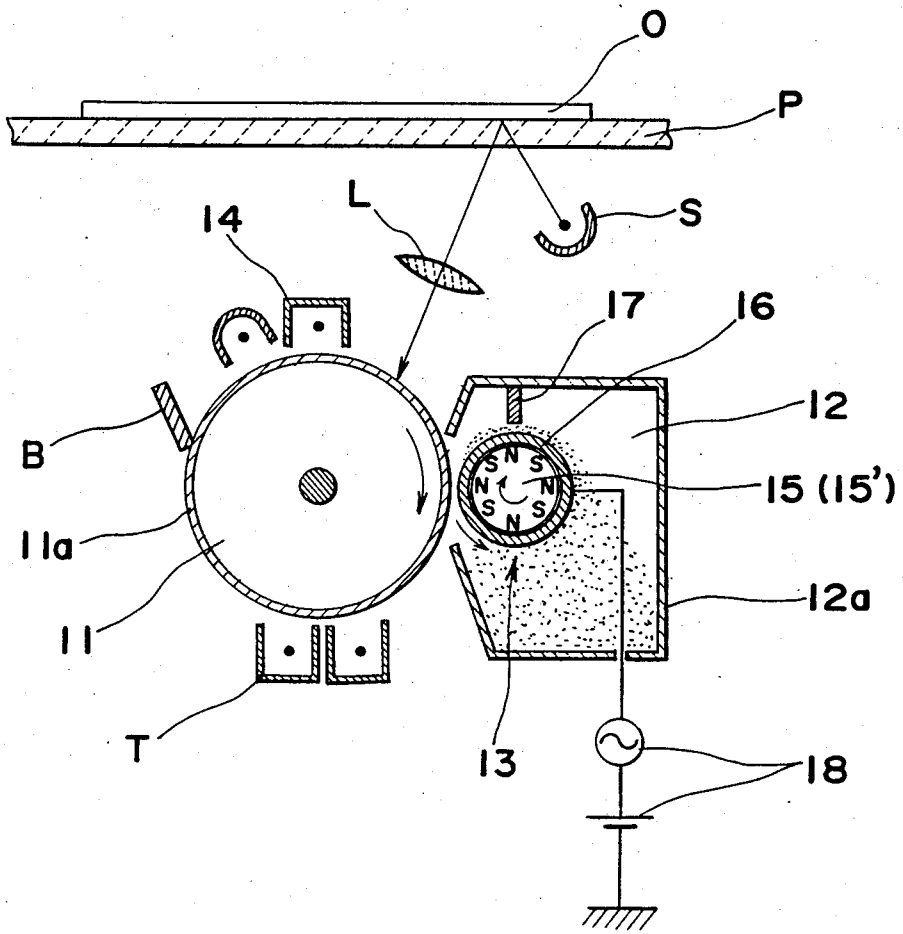
FIG. 2 is a view similar to FIG. 1, which particularly shows an electrophotographic apparatus according to the present invention as applied to an electrophotographic copying machine.

In FIG. 2, there is shown an electrophotographic apparatus according to one preferred embodiment of the present invention as applied to an electrophotographic copying machine.

In FIG. 2, the electrophotographic copying machine generally includes a photoreceptor drum 11 having a photoreceptor layer 11*a* mainly composed of amorphous silicone applied onto the outer peripheral surface of the drum 11, and rotatably disposed at a central portion of the copying machine so as to be rotated in the direction of the arrow, with various processing devices such as a corona charger 14 for uniformly charging the photoreceptor surface 11*a*, an optical system including a light source S for illuminating an original document O placed on a transparent platform P and a lens L for forming an electrostatic latent image of the original document O on the photoreceptor surface 11*a*, a developing device 12 for developing the latent image into a visible toner image, a transfer charger T, and a cleaner blade B, etc. being sequentially disposed around the photoreceptor drum 11 generally in a similar manner to the conventional arrangement of FIG. 1.

In the above embodiment of FIG. 2, the developing device 12 includes a housing 12*a*, a magnet roll 13 having a developing sleeve 16 arranged to rotate in the direction indicated by the arrow and having a developing bias voltage 18 applied thereto on which AC voltage is superposed, and a magnetic roller 15 magnetized in alternately different polar orientations and rotatably provided within said developing sleeve 16 for rotation in the direction of the arrow, with a magnetic brush bristle height restricting plate 17 being provided adjacent to the surface at the upper portion of the developing sleeve 16.

In the above arrangement, the photoreceptor layer 11*a* having amorphous silicone as its main composition is constituted by a p-type amorphous silicone film with a thickness in the range of 0.5 to 1 μm formed on an aluminum drum, an i-type, i.e. intrinsic amorphous silicone film having a thickness in the range of 5 to 25 μm, preferably 8 to 15 μm, and formed on the p-type amorphous silicone film, and a film layer of amorphous silicon carbide, silicon nitride, or silicon oxide further formed on the i-type amorphous silicone film with a thickness in the range of 0.05 to 0.1 μm as a surface layer. The photoreceptor layer 11*a* mainly composed of amorphous silicone and having the construction as described above is uniformly charged up to +200 to +400 V by the corona charger 14, and the electrostatic latent image of the original document O is formed on said photoreceptor layer after exposure by the optical system including the light source S and the lens L so as to be subsequently developed into a visible image by the developing device 12.

In the developing device 12, there is accommodated a developing material composed of electrically insulative carrier particles containing magnetic material and having a diameter in the range of 20 to 60 μm, and electrically insulative toner particles having a diameter in the range of 8 to 12 μm, at a toner concentration of 10 to 20% by weight. The magnetic roller 15 rotatably provided within the developing sleeve 16 of the magnet roll 13 has eight magnetic poles with flux density of 800 to 1000 gauss, and is arranged to be rotated in the direction of the arrow at a speed of 1000 to 2000 rpm. Meanwhile, the developing sleeve 16 of stainless steel provided around the outer peripheral surface of the magnetic roller 15 is driven for rotation in the direction indicated by the arrow at a speed of 100 to 150 rpm, and a developing bias applied thereto in which AC voltages of 300 to 2000 $V_{p-p}$, 1000 to 2000 Hz are superposed on DC voltages of +20 to +100 V. The distance between the photoreceptor surface 11*a* of the photoreceptor drum 11 and the surface of the developing sleeve 16, i.e., the so-called developing gap, is set to be in the range of 0.2 to 0.4 mm. The thickness of the developing material layer on the surface of the developing sleeve 16 is adapted to be larger than the developing gap, and in the range of 0.4 to 0.6 mm by the magnetic brush bristle height regulating plate 17.

Since the photoreceptor mainly composed of amorphous silicone has a slow film forming speed, its film thickness is made thin, with the surface potentials being low in the range of 200 to 400 V, and if the developing bias is only the DC voltage in the case where the developing gap is in the range of 0.2 to 0.4 mm, the density, contrast, and resolution of the image are generally low, but, upon superposition of the AC voltage thereon as described above, high image density, contrast and resolution can be obtained.

If the developing gap is set to be larger than 0.4 mm, the image density can not be increased, even when the above AC voltage is superposed on the developing bias voltage, while on the contrary, if the developing gap is reduced to less than 0.2 mm, there are such disadvantages that stricter dimensional accuracy is required for the developing sleeve and the photoreceptor, and the smooth flow of the developing material is also obstructed, thus resulting in unevenness in the resultant images.

Embodiment 2

In a similar electrophotographic copying machine as in the above embodiment 1 (FIG. 2), there is provided in the developing device a developing material composed of electrically insulative ferrite carrier containing magnetic material and having a diameter in the range of 20 to 100 μm or carrier or iron particles subjected to oxidizing treatment or a mixed carrier of these to materials, and electrically insulative toner particles having a diameter in the range of 8 to 12 μm, at a toner concentration of 4 to 10% by weight. The magnetic roller 15' provided in the developing sleeve 16 for the magnet roll 13 has a flux density of 600 to 800 gauss in this embodiment, with the positions of the magnetic poles thereof being fixed. The developing sleeve 16 is adapted to be rotated in the direction of the arrow at revolutions of 100 to 300 rpm, and has impressed therein a developing bias in which AC voltage of 300 to 1000 $V_{p-p}$, 1000 to 3000 Hz are superposed on DC voltages of +20 to +150 V. The distance between the photoreceptor surface 11*a* of the photoreceptor drum 11 and the surface of the developing sleeve 16, i.e., the developing gap, is in the range of 0.2 to 1 mm. By the magnetic brush bristle height restricting plate 17, the thickness of the developing material layer on the surface of the developing sleeve 16 is regulated to be larger than the developing gap and in the range of 0.4 to 1.2 mm.

In the case where the developing gap exceeds 1 mm, image density is low, even when the AC voltage is superposed on the developing bias voltage. If the developing bias voltage is limited only to DC voltage when the developing gap is in the range of 0.2 to 1 mm, sufficient image density, image contrast and resolution are not available, but when the AC voltage as described above is superposed on the DC voltage for the developing bias, it becomes possible to obtain sufficiently high image density, image contrast and resolution as desired. Reduction of the developing gap below 0.2 mm is not preferable due to the reasons similar to those discussed in embodiment 1.

As is clear from the foregoing description, according to the present invention, the electrophotographic apparatus includes the photoreceptor mainly composed of low potential amorphous silicone and the developing device containing the developing material composed of electrically insulative composite components, and is characterized in that the thickness of the layer of the developing material on the developing sleeve in the developing device is set to be larger than the distance between the surface of the developing sleeve and the surface of the photoreceptor, with the distance being set to be in the range of 0.2 to 1 mm, while AC voltage is superposed onto the developing bias voltage applied to the developing sleeve. Accordingly, the time period from maintenance to maintenance is advantageously increased, and the improved electrophotographic apparatus capable of providing images at high density, high contrast and high resolution can be produced by the large charge amount on the photoreceptor surface and the strong developing electric field, irrespective of the fact that the low potential amorphous silicone mainly composed of amorphous silicone is employed.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An electrophotographic apparatus comprising: a photoreceptor mainly composed of amorphous silicon having a thickness in the range of 5 to 25 μm and low surface potential, and a developing device employing a developing material including electrically insulative composite components, said developing device having a developing sleeve and means for impressing on said sleeve a developing bias voltage on which an AC voltage is superposed, and a magnetic roller having magnetic poles and accommodated within said developing sleeve.

2. An electrophotographic apparatus as claimed in claim 1, wherein the thickness of the developing material layer on the surface of the developing sleeve of said developing device is larger than the distance between the surface of said developing sleeve and the surface of the photoreceptor, said distance being in the range of 0.2 to 1 mm.

3. An electrophotographic apparatus as claimed in claim 2, wherein said distance between the surface of the developing sleeve and the photoreceptor surface is in the range of 0.2 to 0.4 mm.

4. An electrophotographic apparatus comprising: a photoreceptor mainly composed of amorphous silicon having a thickness in the range of 5 to 25 μm and low surface potential, and a developing device employing a developing material including electrically insulative composite components, said developing device having a developing sleeve and means for impressing on said sleeve a developing bias voltage on which an AC voltage is superposed, and a magnetic roller having magnetic poles and accommodated within said developing sleeve, the thickness of the developing material layer on the surface of the developing sleeve of said developing device being larger than the distance between the surface of said developing sleeve and the surface of the photoreceptor.

5. An electrophotographic apparatus as claimed in claim 4, wherein said developing sleeve is rotated, with said magnetic roller being fixed.

6. An electrophotographic apparatus as claimed in claim 4, wherein both said developing sleeve and said magnetic roller of the developing device are rotated.

7. An electrophotographic apparatus as claimed in claim 4, wherein said distance between the surface of the developing sleeve and the photoreceptor surface is in the range of 0.2 to 1 mm.

8. An electrophotographic apparatus as claimed in claim 4, wherein said distance between the surface of the developing sleeve and the photoreceptor surface is in the range of 0.2 to 0.4 mm.

9. An electrophotographic apparatus as claimed in claim 1 in which said photoreceptor comprises an aluminum substrate, a p-type layer of amorphous silicon on said substrate, a layer of intrinsic amorphous silicon on said p-type layer, and a layer of a nitride taken from the group consisting of silicon nitride and silicon oxide on said intrinsic amorphous silicon layer.

* * * * *